United States Patent [19]

Merz et al.

[11] 4,003,070

[45] Jan. 11, 1977

[54] APPARATUS FOR TREATING PHOTOGRAPHIC MATERIALS

[75] Inventors: Werner Merz, Oberelchingen; Werner Michaelis, Stuttgart, both of Germany

[73] Assignee: Merz & Co., Oberelchingen, Germany

[22] Filed: Nov. 20, 1974

[21] Appl. No.: 525,372

[30] Foreign Application Priority Data

Apr. 4, 1974 Germany ..... 2416393

[52] U.S. Cl. ..... 354/322; 134/64 P; 354/324

[51] Int. Cl.[2] ..... G03D 3/08; G03D 3/02

[58] Field of Search ..... 354/297, 313, 319, 320, 354/321, 322, 324, 339; 134/64 P, 122 P

[56] References Cited

UNITED STATES PATENTS

| | | | |
|---|---|---|---|
| 2,570,627 | 10/1951 | Albin | 354/319 X |
| 3,690,758 | 9/1972 | Knechtel et al. | 354/320 X |
| 3,741,093 | 6/1973 | Komori et al. | 354/321 |

*Primary Examiner*—Fred L. Braun
*Attorney, Agent, or Firm*—Michael J. Striker

[57] ABSTRACT

A pair of drums is mounted for rotation about at least substantially parallel axes which are located in a common plane. The drums form with one another an axial gap and bodies or walls are located adjacent to the drums and define with the circumferential walls thereof a first channel section which surrounds the circumference of the drums at least in the region of the gap at one side of the plane, and a second channel section which surrounds the circumference of the drums at least in the region of the gap at the other side of the plane. The channel sections merge with one another in the gap. An arrangement is provided for circulating a treating fluid through the channel sections and into the interior of the respective drums and a feeding arrangement feeds the photographic material into the channel sections so that it sequentially moves through the first and thereupon through the second channel section and becomes treated by contact with the treating fluid.

41 Claims, 6 Drawing Figures

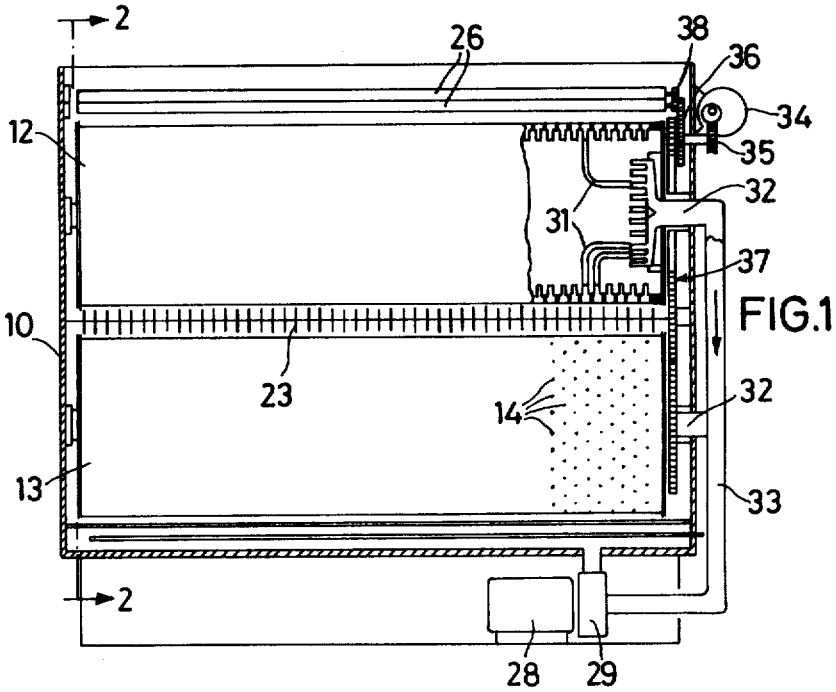
FIG.1
FIG.2
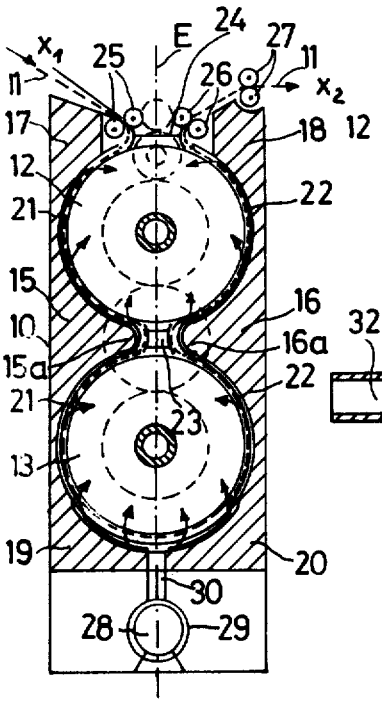
FIG. 3
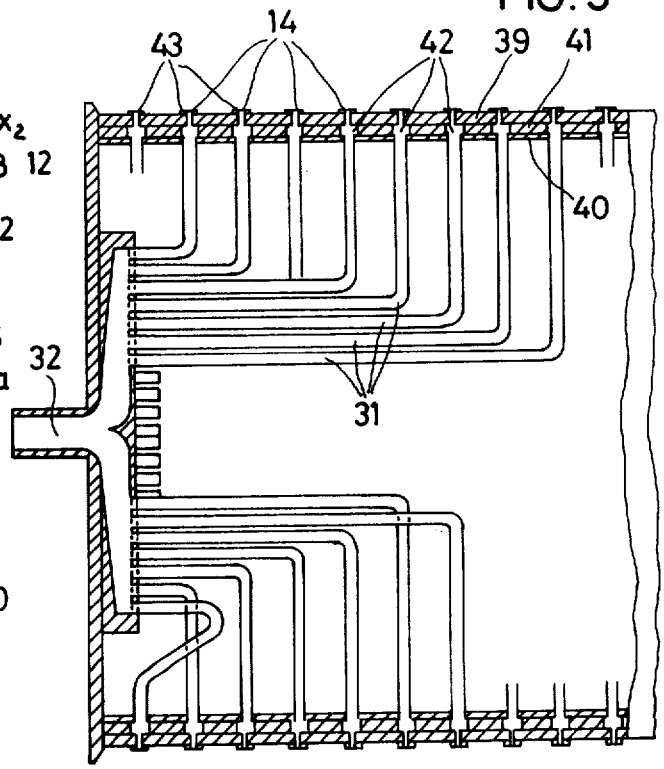

APPARATUS FOR TREATING PHOTOGRAPHIC MATERIALS

BACKGROUND OF THE INVENTION

The present invention relates generally to an apparatus for treating of photographic materials, more particularly to an apparatus for treating — especially for developing — photographic materials by content with a treating fluid.

Apparatus is already known from the prior art in which the photographic material to be treated is transported in form of strips or individual sheets by two or more drums which turn and thereby advance a transporting belt or the like, which in turn then engages and advances the photographic material.

A further apparatus known from the prior art proposes to guide the photographic material to be treated over plates which are formed with suction nozzles so that treating fluid is pulled through these nozzles and, in entering the same, tends to pull the photographic material against the plate surface. The advancement of the photographic material in this case is effected by imparting a reciprocating movement to the plates. This type of construction has been found to be disadvantageous for a number of reasons, including the fact that a relatively complicated drive is required to impart the reciprocatory movement to the plates and that despite this the advancement of the photographic material is not uniform. Moreover, this type of apparatus as well as the others known from the prior art, requires a relatively large amount of treating fluid which is needed to fill the various spaces that are traversed by the photographic material.

An additional disadvantage of the prior art apparatus of the type in question, insofar as it operates with suction in order to draw the photographic material against a component of the apparatus, results from the fact that intermediate the areas where the photographic material is pulled by suction against such a component or components, the material tends to belly out and to contact other surfaces with which such contact is not intended. This can lead to damage to the emulsion or other sensitive layers of the photographic material, or it can result in improper and non-uniform developing of a photographic material.

SUMMARY OF THE INVENTION

Accordingly, it is a general object of the present invention to provide an improved apparatus for treating of photographic materials, which is not possessed of the disadvantages of the prior art.

A more specific object of the invention is to provide such an apparatus which offers for the photographic material a relatively long treating path but requires only a comparatively small amount of treating fluid.

A further object of the invention is to provide such an improved apparatus which should be compact in its construction.

An additional object of the invention is to provide such an apparatus in which the photographic material is to be drawn by suction against certain components of the apparatus, but without thereby being exposed to the difficulties experienced in the prior art.

In keeping with these objects, and with others which will become apparent hereafter, one feature of the invention resides in an apparatus for treating photographic materials, especially for developing such materials, which comprises a pair of drums mounted for rotation about at least substantially parallel axes which are located in a common plane, the drums forming with one another an axial gap. Channel-forming means is provided adjacent the drums and defines therewith a first channel section surrounding the circumference of the drums at least in the region of the gap at one side of the plane, and a second channel section surrounding the circumference of the drums at least in the region of the gap but at the other side of the plane. The channel sections merge with one another in the gap. Circulating means is provided for circulating a treating fluid through the channel sections and feeding means feeds the photographic material for movement sequentially through the first and thereupon through the second channel section.

It is advantageous if the channel sections surround substantially the entire circumference of the respective drums on the respective sides of the aforementioned common plane, and if the channel sections are either of uniformly narrow width or else have a width which gradually decreases in the direction of flow of the treating fluid.

By resorting to the present invention, we are able to provide an apparatus which offers a relatively long treating path for the photographic material but requires only a relatively small amount of treating fluid in order to contact the photographic material during its entire travel over the length of the treating path. We have found that a particularly advantageous construction is obtained if the channel-forming means assures that the photographic material first travels around the circumference of one of the drums at one side of the plane, is then deflected into the gap towards the plane and is thereupon deflected outwardly to travel around the circumference of the other drum at the same side of the gap, to repeat the movement with respect to the two drums at the opposite side of the plane. Such a construction assures a particularly long treating path for the photographic materials but requires only a minimum of treating fluid and makes it possible to utilize an apparatus having relatively small dimensions.

A particularly important aspect of the invention is to employ suction to draw the photographic or other material against the rotating drums, which for this purpose are provided with perforations in their circumferential walls so that the treating fluid can enter from the channel sections into the interior of the drums, thereby exerting suction upon the photographic materials travelling through the channel sections. The treating fluid is supplied from outside towards the walls of the drums so as to travel over the entire length of the channel sections, and over this entire length it is drawn into the drums through the perforations in the walls thereof, and is withdrawn by appropriate suction means from the interior of the drums. Thus, the photographic material is reliably guided by the circumferential walls of the drums over almost its entire travel in the treating path. The treating fluid itself can with particular advantage be supplied into the channel sections in or in the region of the common plane in which the axis of rotation of the two drums are located, and its admission will advantageously be at a location that is spaced as far as possible from the point of entry of the photographic material into the channel sections. The treating fluid will then be uniformly distributed into the two channel sections and will be uniformly withdrawn into the interiors of the drums.

In order to avoid difficulties during the withdrawal of the treating fluid from the drum interiors, it is advantageous if the space or spaces (e.g. the gap) between the drums and/or the inlets and outlets of the channel sections, are provided with devices which may offer a sealing action (at the inlet and outlet) and which guide the photographic material while preventing an undesired outflow of the treating fluid. To assure that both the front side and the rear side of the photographic material is properly contacted by the treating fluid, it is advantageous if the outer circumferential surfaces of the drums are provided with projections which prevent direct surface-to-surface contact between the drums and the photographic material, and intermediate these projections perforations may be located through which the treating fluid can flow into the interior of the respective drum. Suction conduits may be located in the interior of each drum and may each communicate with one of these perforations and in turn communicate with a collecting conduit that discharges the treating fluid to the exterior of the respective drum, for example, at an axial end thereof.

A particularly advantageous embodiment of the present invention utilizes peristaltic pumps, or rather the hoses thereof, which are mounted on the drums and rotate with the same for the purpose of withdrawing the treating fluid by suction. The action of these pumps depends upon the squeezing of the hoses by appropriate squeezing elements, so that due to this squeezing the treating fluid is advanced lengthwise of the hoses. This eliminates more complicated conventional pumps and the expenses and constructional difficulties resulting from their use.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a side view of one embodiment of the present invention, with certain portions omitted for clarity;

FIG. 2 is a section taken on line 2 — 2 of FIG. 1;

FIG. 3 is a fragmentary axial section through a drum of a further embodiment of the invention;

DESCRIPTION OF THE PREFERRED EMBODIMENTS

Figure 6:
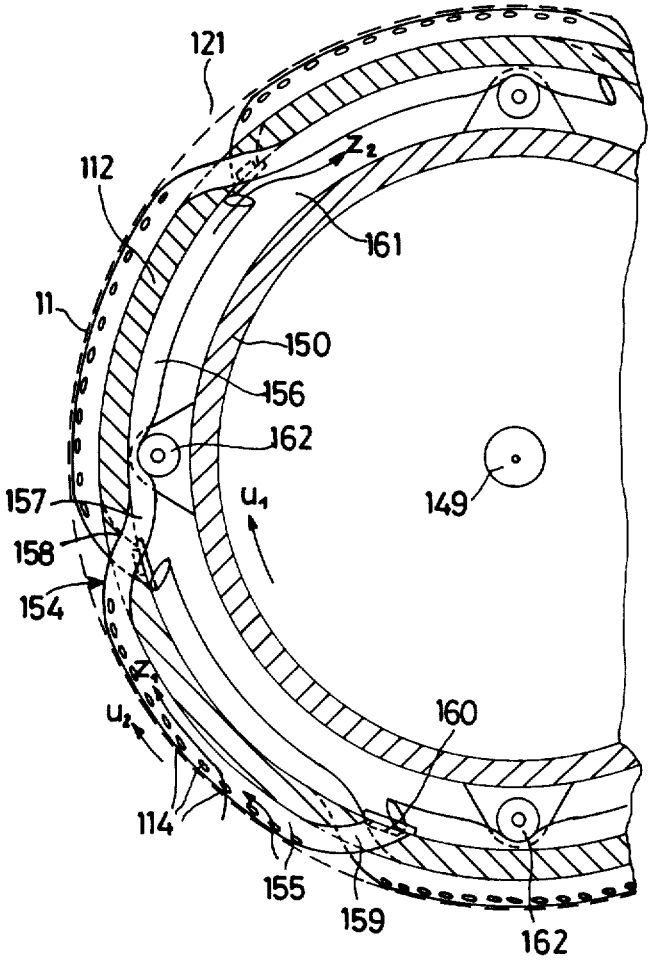
FIG. 6 is a section taken on line 6 — 6 of FIG. 5.

FIGS. 1 and 2 illustrate one embodiment of the invention where the apparatus has a housing 10 in which the two conveying drums 12 and 13 are mounted for rotation about at least substantially parallel axes which are located in a common vertical plane E. It should be understood that they could also be located in a more or less horizontal plane E. The purpose of the drums 12, 13 is to contact photographic material 11 (shown in broken lines in FIG. 2) of strip-shaped or sheet-shaped configuration. This material is fed into the housing 10 in the direction of the arrow X1 and leaves the housing in the direction of X2.

The drums 12, 13 are each rotatable about its respective axis and are formed with circumferential cylinder walls which have a plurality of small bores or perforations 14 as shown fragmentarily in FIG. 1. Bodies 15, 16, 17, 18, 19 and 20 are accommodated in the housing 10 (see FIG. 2) which are so shaped that they form with the circumference of the drums 12 and 13 a pair of channel sections 21 and 22. The channel section 21 is located at one side of the plane E and the channel section 22 is located at the opposite side of the plane E. Each of the channel sections has substantially the shape of a figure 3, that is the channel section 22 in FIG. 2 resembles a figure 3 and the channel 21 resembles an inverted figure 3; together the two channel sections 21, 22 resemble generally a figure 8. The width of the channel sections is relatively small in radial direction but each channel section extends over substantially one half of the circumference of each of the drums 12, 13. These drums form with one another an axial gap into which the rounded portions **15*a* and 16*a* of the members 15, 16 project. The portions 15*a* and 16*a* form in this gap with one or more bodies 23 located in the gap a connection between that portion of the respective channel sections 21, 22 surrounding the lower drum 13 and that portion of the respective channel sections 21, 22 surrounding the upper drum 12**.

At the upper ends the channel sections 21 and 22 terminate at a deflecting wall 24 and are there closed except for the presence of two narrow slots through which the photographic material 11 enters in the direction of the arrow X1 through a pair of cooperating rollers 25, and through the other of which slots the material 11 exits through feed and fluid-stripping roller pairs 26, 27 in the direction of the arrow X2. The direction of movement of the material 11 through the channel sections 21, 22 is clearly shown in FIG. 2, as is the fact that it will be in constant contact with the treating fluid while it is in the channel sections 21, 22.

The treating fluid, for instance a developer liquid, is circulated through the apparatus and fills the channel sections 21, and 22. It may be circulated by a pump 29 which is driven by a motor 28 and which circulates the treating fluid via the inlet 30 through the channel sections 21 and 22 from where the treating fluid enters through the perforations 14 into the interior of the respective drums 12, 13. The perforations 14 in the embodiment of FIGS. 1 and 2 communicate with suction conduits 31 mounted in the interior of the respective drums 12, 13 (see FIG. 1) and which in turn communicate with collecting channels 32 which discharge in a suction conduit 33 that communicates with the suction side of the pump 29.

The drums 12 and 13 are driven in rotation by a motor 34 which drives via a stepdown drive, for instance a worm drive 35, and a gear drive 36 and 37 the drums 12 and 13, and which also drives the rollers 25, 26 and 27 via gears 38.

The suction effect of the pump 29 produces a suction via the conduits 33, 32 and 31 at the perforations 14, so that treating fluid is drawn from the channel sections 22, 21 through the perforations 14 into the interior of the respective drums 12, 13. This inflow of the treating fluid from the channel sections 21, 22 into the space between the photographic material 11 and the outer circumferential surfaces of the drums 12, 13 and thereupon to the interior of the latter via the perforations 14.

exerts a suction effect on the photographic material 11 pulling the same towards the outer circumferential surfaces of the drums 12, 13 so that it is transported along when the drums rotate. When the material reaches the rounded portions 15*a* or 16*a* it is deflected from one drum to the other, towards the plane E, and a similar deflection takes place at the wall 24. This means that a quite long treatment path is obtained for the photographic material 11, and the reliable suction effect exerted by the treating liquid flowing to the interior of the drum 12, 13 assures uniform and continuous speed of advancement of the photographic material 11 through the apparatus.

FIG. 3 shows a somewhat different drum 12 which can be used in the apparatus of FIGS. 1 and 2, it being understood that the drum 13 may also be configurated in the manner in which this is explained to the drum 12 in FIG. 3. The outer wall of the drum 12 in FIG. 3 is constituted by an outer tube 39 and an inner tube 40 which is located within the outer tube 39 with clearance. A plurality of spacing rings 41 is located in this clearance and connected with the tubes, alternately, these rings would also be of one piece with one or both of these tubes. In this construction there are formed a plurality of annular chambers 42 into which the perforations 14 open in the same radial plane. It is also possible to provide transverse walls in the annular chambers 42, distributed over the circumference of the drum 12 and subdividing each annular chamber 42 into individual compartments or segments so that each perforation 14 (or each group of perforations 14) communicates with only one of these compartments. The outer circumferential surface of the outer tube 39 is formed with projections 43 surrounding the perforations 14, to assure that the photographic material 11 (not shown in FIG. 3) which contacts the outer circumferential surface of the outer tube 39 will remain spaced from this surface, thus permitting access of the treating fluid to the reverse side of the photographic material, that is that side which faces the outer circumferential surface of the tube 39. This is of importance if the photographic material is of the type that is provided on both of its sides with layers that must be developed or otherwise treated.

Figure 4:
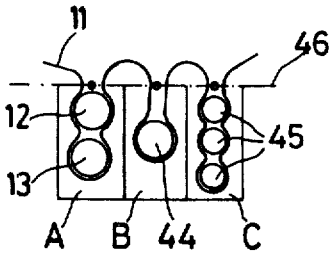
FIG. 4 is a diagrammatic illustration, showing how the apparatus of the present invention can be utilized in a multi-stage treating installation.

FIG. 4 shows by way of example and in a purely diagrammatic manner an installation which may utilize the apparatus according to the present invention for multi-stage processing. The photographic material 11 initially travels via the drums 12, 13 of the apparatus as for instance shown in FIGS. 1 and 2. These drums 12, 13 are arranged in a first chamber A. Subsequently, for example for a second treatment, the material 11 travels around a further drum 44 located in a chamber B, and thereupon it may travel around additional drums 45 located in a chamber C. Reference numeral 46 diagrammatically identifies a drive which may be common to all of the drums 12, 13, 44 and 45. With such an installation, and assuming continuous operation and continuous advancement of the material 11 through the separate stages or chambers A, B and C whose number may be selected at will, the time required for processing in the individual chambers (and which may not be the same for each of the chambers) can be readily selected by an appropriate selection of the number and diameters of the drums in the respective chambers.

Figure 5:
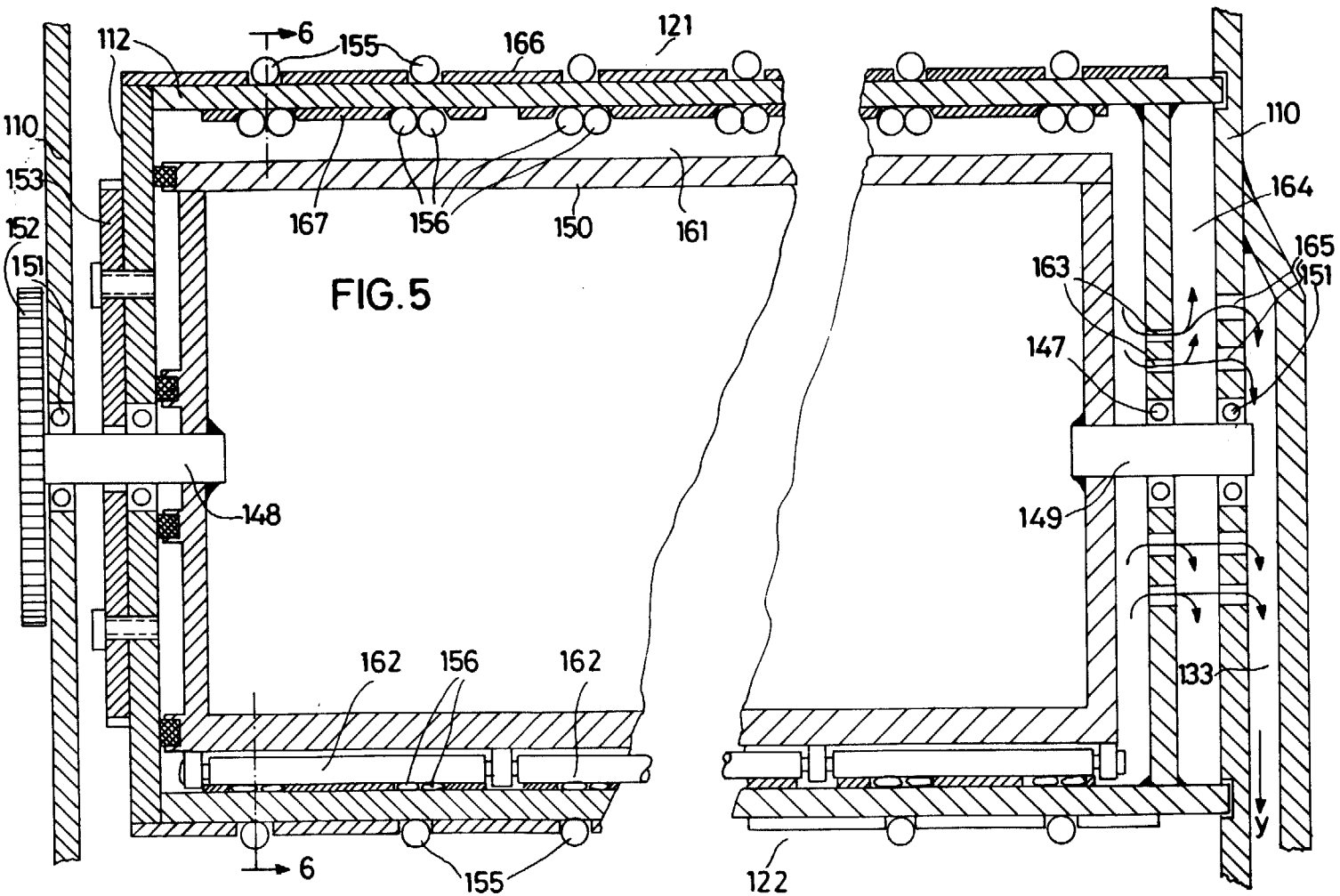
FIG. 5 is an axial section through a drum according to a further embodiment of the invention which uses peristaltic pumps.

FIGS. 5 and 6, finally, show a further embodiment of the invention in which peristaltic pumps are utilized. In this embodiment only a single drum 112 has been illustrated by way of example, it being understood, however, that more than a single drum, such as the two drums of FIGS. 1 and 2, can and ordinarily will be utilized.

The drum 112 in FIGS. 5 and 6 is mounted on stub shafts 148 and 149, for example by means of synthetic plastic or other anti-friction bearings 147. The stub shafts 148 and 149 are firmly connected with an inner drum 150 and supported in a housing or frame 110, for example again by means of synthetic plastic or other anti-friction bearings 151. A gear 152 is mounted on the shaft 148 and serves to drive the inner drum 150 in rotation. The suction and conveying drum 112 is connected with a gear 153 forming a part of a gear drive corresponding to the gear drive 37 in FIG. 1; the gear 153 serves to drive the drum 112 in rotation.

In the embodiments of FIGS. 5 and 6, peristaltic pumps are utilized, as already mentioned. For this purpose the drum 112 is provided with a plurality of hoses 154 of peristaltic pumps. These hoses extend, as shown in FIG. 6, over a portion of the drum circumference, for example over a portion of an arc of 90° or more. In individual radial planes, four (or more or fewer) of the hoses 154 are distributed about the circumference of the drum 112. Each of the hoses 154 is bent to a substantially S-shaped configuration and has a leading end portion 155 and a trailing end portion 156 which are connected by an intermediate portion 157 that extends through an opening 158 in the circumferential wall of the drum 112. The leading end portion 155 of each hose 154 is located at the outer circumferential surface of the drum 112, whereas the trailing end portion 156 (which may be of any desired length, and may even extend several times around the inner circumference of the drum 112) is arranged on the inner surface of the drum wall. The leading end portion 155 is anchored on the drum 112 at its leading end at 159 and closed by a plug 160 or the like. Openings 114 are formed in the leading end portion 155 to permit entry of the treating fluid which flows through the channel sections 121 or 122 (the outer boundary walls of these channel sections have been omitted in FIGS. 5 and 6 for clarity). The treating fluid can then enter in the direction of the arrow Z1 into the interior of the leading end portion 155 of the respective hose 154, and can flow via the intermediate portion 157 into the trailing end portion 156, from where it in turn flows in the direction of the arrow Z2 into the interior 161 between the inner drum 150 and the outer drum 112. The inner or trailing end portion 156 is in firm engagement with the inner circumferential surface of the wall of the drum 112.

Mounted on the inner drum 150 are squeezing members which here are illustrated in form of squeezing rollers 162. Any desired number of these members may be provided and they are distributed circumferentially as well as axially of the drum 150, being mounted for turning movement in such a manner that they encounter as little friction as possible during their turning. They are so arranged than when the inner drum 150 is rotated in the circumferential direction U1 they will move into engagement with the trailing end portions 156 and continuously squeeze them lengthwise of the end portion 156, to subsequently move out of engagement with these end portions 156 over a part of the circumferential travel of the drum 150. This squeezing out of contents (of the treating fluid) from the trailing end portions 156 causes a suction effect in the hoses 154, and this suction effect draws the treating fluid in the direction of the arrows Z1 and Z2 from the exterior of the drum 112 to the interior thereof, producing a suction in the perforations 114 over which the photographic material 11 travels. The circumferential speed U1 is greater than the circumferential speed of the drum 112 in the direction of the arrow U2, assuming that both of the drums 112 and 150 are driven in one and the same direction. It is also possible to have the drums rotate in mutually opposite directions. It is particularly advantageous if the circumferential speed U1 of the drum 150 can be varied.

The treating fluid which is expelled from the trailing end portions 156 of the hoses 154 by the squeezing rollers 162, enters the annular clearance 161 between the drums 112 and 150, from where it can flow via bores 163 and space 164 and bores 165 into the return flow channel 133, to travel from there in the direction of the arrow Y to the pump 29 (see FIG. 1) which circulates the treating fluid.

Spacing rings 166 on the outer circumferential surface of the drum 112, and 167 on the inner side of the drum 112 assure that the individual hoses 154 (i.e., the portions 155 and 156 thereof) maintain a certain distance from one another in axial direction of the drum 112 and cannot shift in this axial direction. The rings 166 and 167 may also be of one part with the drum 112 rather than being separate members.

It will be appreciated that whatever seals that are required will be provided in order to seal the individual channel spaces with reference to one another and/or to the exterior to the extent necessary. However, the utilization of such seals is fully within the capability of those skilled in the art and requires no detailed description.

It will be understood that the squeezing elements need not be rollers, and that they could also be mounted stationarily at the interior of the drum 112 rather than being mounted on the rotatable drum 150. If the leading end portions 155 each extend only over a small portion of the circumference of the drum 112, in which case it is of course necessary to provide a plurality of the hoses 154 which must be distributed circumferentially and axially of the drum 112, a condition of maximum effectiveness and uniformity of the suction effect upon the photographic material 11 can be obtained. The hoses 154 are advantageously of synthetic plastic material, similar types of which are suitable and of which silicon rubber has been found to be particularly advantageous because it can be economically used to produce the hoses 154 and offers the elasticity which is necessary for proper operation of peristaltic pumps.

It will be understood that each of the elements described above, or two or more together, may also find a useful application in other types of constructions, differing from the types described above.

While the invention has been illustrated and described as embodied in an apparatus for treating photographic materials, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for treating photographic materials, especially for developing such materials, comprising housing means forming a chamber having an inner wall; at least one drum mounted in said chamber for rotation about an axis, said drum having a circumferential wall spaced from said inner wall so as to form a channel in which photographic material may be guided about said drum; aperture means in said circumferential wall communicating the interior of said drum with the exterior thereof; annular means concentrically mounted in the interior of said drum and having a diameter slightly smaller than the diameter of said drum so as to form with an inner wall surface of said circumferential wall a narrow annular clearance which communicates with said aperture means; and circulating means communicating with said clearance for circulating a treating fluid from said chamber through said aperture means into said clearance, to thereby create a suction which draws said material towards an outer surface of said circumferential wall to be conveyed during rotation of said drum.

2. An apparatus as defined in claim 1, wherein said housing further comprises projection means extending into said chamber so as to define with said outer surface of said circumferential wall a narrow gap extending circumferentially of said drum and through which said material travels; and means for admitting treating fluid into said gap.

3. An apparatus as defined in claim 1, further comprising an additional drum mounted in said chamber for rotation about an axis parallel to the first-mentioned axis, said drums forming with one another an axial gap; said inner wall adjacent said drums defining therewith a first channel section surrounding the circumference of said drums at least in the region of said gap at one side of a plane encompassing both said axes, and a second channel section surrounding the circumference of said drums at least in the region of said gap at the other side of said plane, said channel sections merging with one another in said gap; said circulating means circulating said treating fluid through said channel sections; and feeding means for feeding said material for movement sequentially through said first and thereupon through said second channel section.

4. An apparatus as defined in claim 3, wherein said plane is an upright plane and said drums are located one above the other.

5. An apparatus as defined in claim 3, wherein said channel sections are of constant width.

6. An apparatus as defined in claim 3, wherein said inner wall also defines said first and second channel sections adjacent the remainder of the circumferences of said drums at said one side and said other side of said plane, respectively.

7. An apparatus as defined in claim 3, said feeding means comprising a first inlet for admitting said photographic material into one of said channel sections; and said circulating means comprising a second inlet located in the region of said plane for admitting said treating fluid into both of said channel sections for travel therein and entry into the respective drums.

8. An apparatus as defined in claim 7, wherein said second inlet is remote from said first inlet.

9. An apparatus as defined in claim 3, said first channel section having an intake end for the photographic material and said second channel section having a discharge end for said material; and further comprising means in at least one of said ends for guiding said material in a desired path.

10. An apparatus as defined in claim 3, said first channel section having an intake end and said second channel section having a discharge end for the photographic material; and wherein said feeding means comprises pairs of feeding and stripping rollers located at said intake and discharge ends and between which said photographic material is compelled to pass.

11. An apparatus as defined in claim 3, wherein said drums have outer circumferential surfaces formed with raised projections for engagement by said photographic material.

12. An apparatus as defined in claim 3, wherein said aperture means comprises perforations in the walls of said drums through which said treating fluid enters the interiors thereof; and wherein said circulating means comprises suction conduits in said interiors each communicating with at least one of said perforations.

13. An apparatus as defined in claim 12, said circulating means further comprising a collecting conduit communicating in each drum with said suction conduits and extending along the axis of rotation of the respective drum.

14. An apparatus as defined in claim 3, wherein said aperture means comprises perforations in said circumferential wall, said circulating means comprises a plurality of suction conduits located in each interior of said drums, each of said annular clearences communicating with at least one of said perforations and with a respective one of said suction conduits.

15. An apparatus for treating photographic materials, especially for developing such materials, comprising housing means forming a chamber having an inner wall; at least one drum mounted in said chamber for rotation about an axis, said drum having a circumferential wall spaced from said inner wall so as to form a channel in which photographic material may be guided about said drum; aperture means in said circumferential wall communicating the interior of said drum with the exterior thereof; annular means concentrically mounted in the interior of said drum and having a diameter slightly smaller than the diameter of said drum so as to form with an inner surface of said circumferential wall a narrow annular clearance which communicates with said aperture means, said annular means comprising a plurality of ring members subdividing said clearance into a plurality of annular collecting chambers; a plurality of suction conduits located in the interior of said drum, each of said collecting chambers communicating with said aperture means and with at least one of said suction conduits; and circulating means communicating with said clearance for circulating a treating fluid from said chamber through said aperture means into said clearance, to thereby create a suction which draws said material towards an outer surface of said circumferential wall to be conveyed during rotation of said drum.

16. An apparatus as defined in claim 15, wherein said suction conduits are tubes.

17. An apparatus for treating photographic materials, especially for developing such materials, comprising a pair of drums mounted for rotation about at least substantially parallel axes which are located in a common plane, said drums forming with one another an axial gap, each of said drums having a hollow interior bounded by a circumferential wall and an inner tubular wall concentric to and forming with said circumferential wall an annular clearance, a plurality of ring members in said clearance and subdividing the same into a plurality of annular collecting chambers each communicating with perforations in said circumferential wall and with at least one suction conduit located in said hollow interior; channel-forming means adjacent said drums and defining with said drums a first channel section surrounding the circumference of said drums at least in the region of said gap at one side of said plane, and a second channel section surrounding the circumference of said drums at least in the region of said gap at the other side of said plane, said channel sections merging with one another in said gap; circulating means for circulating a treating fluid through said channel sections; and feeding means feeding said photographic material for movement sequentially through said first and thereupon through said second channel section.

18. An apparatus for treating photographic materials, especially for developing such materials, comprising a pair of drums mounted for rotation about at least substantially parallel axes which are located in a common plane, said drums forming with one another an axial gap; channel-forming means adjacent said drums and defining with said drums a first channel section surrounding the circumference of said drums at least in the region of said gap at one side of said plane, and a second channel section surrounding the circumference of said drums at least in the region of said gap at the other side of said plane, said channel sections merging with one another in said gap; circulating means for circulating a treating fluid through said channel sections, said circulating means comprising peristaltic pumps having pumping hoses which rotate with the respective drums and withdraw said treating fluid into the interior of said drums; and feeding means feeding said photographic material for movement sequentially through said first and thereupon through said second channel section.

19. An apparatus as defined in claim 18, wherein a plurality of said pumping hoses are distributed axially and circumferentially of each of said drums.

20. An apparatus as defined in claim 19; and further comprising spacing rings on said drums for maintaining the pumping hoses on the respective drums spaced from one another.

21. An apparatus as defined in claim 19, said drums each having a longitudinal dimension and a circumferential dimension; and wherein said pumps comprise squeezing elements which are distributed over at least one of said dimensions and serve to squeeze portions of the respective hoses to thereby effect pumping of said treating fluid.

22. An apparatus as defined in claim 18, wherein said hoses are of synthetic plastic material.

23. An apparatus as defined in claim 22, wherein said synthetic plastic material is silicone rubber.

24. An apparatus as defined in claim 18, wherein said drums have circumferential walls with outer surfaces and said hoses are mounted on said outer surfaces and have suction openings spaced from the latter for entry of said treating fluid; and wherein said pumps further comprise squeezing elements spaced from said outer surfaces and suction openings for squeezing said hoses and effecting pumping of said treating fluid therethrough.

25. An apparatus as defined in claim 21, wherein said hoses have portions extending through said walls into the interiors of the respective drums, and wherein said squeezing elements are located in said interiors adjacent the inner surfaces of said walls.

26. An apparatus as defined in claim 25, wherein said hoses have portions located at said outer surfaces and each extending over only a portion of the circumference of the respective drum, and wherein said hoses on each drum are distributed circumferentially thereof.

27. An apparatus as defined in claim 25, wherein said squeezing elements are mounted in said interiors for squeezing said portions of said hoses against said inner surfaces when said drums and said hoses rotate.

28. An apparatus as defined in claim 27, wherein said squeezing elements are squeezing rollers.

29. An apparatus as defined in claim 24, said hoses having first closed end portions located at said outer surfaces and provided with said suction openings, second end portions located within the respective drums on the inner surfaces thereof for engagement by said squeezing elements, and intermediate portions extending through and anchored in openings in said walls.

30. An apparatus as defined in claim 24; said squeezing elements being stationary relative to the respective drums.

31. An apparatus as defined in claim 24; said squeezing elements being rotatable relative to the respective drums at a circumferential speed different from that of the rotating drums.

32. An apparatus as defined in claim 24; further comprising a tubular mounting member in each of said drums and forming with the circumferential wall of the respective drum an annular clearance, said squeezing elements being mounted on the respective mounting members; and further comprising suction means communicating with the respective annular clearance for withdrawing treating fluid which enters the same.

33. An apparatus as defined in claim 32, wherein said drums have endwalls located at opposite axial ends, at least one endwall of each drum being formed with at least one opening which communicates with the associated annular clearance and with said suction means.

34. An apparatus as defined in claim 32, said mounting members each having a shaft extending therethrough on which the respective mounting member rotates; and wherein said suction means communicates with the respective annular clearance through the shaft of the associated mounting member.

35. An apparatus for treating photograhic materials, especially for developing such materials, comprising housing means forming a chamber having an inner wall; at least one drum mounted in said chamber for rotation about an axis, said drum having a circumferential wall spaced from said inner wall so as to form a channel in which photographic material may be guided about said drum; aperture means in said circumferential wall communicating the interior of said drum with the exterior thereof; annular means concentrically mounted in the interior of said drum and having a diameter slightly smaller than the diameter of said drum so as to form with an inner surface of said circumferential wall a narrow annular clearance which communicates with said aperture means; and circulating means communicating with said clearance for circulating a treating fluid from said chamber through said aperture means into said clearance, to thereby create a suction which draws said material towards an outer surface of said circumferential wall to be conveyed during rotation of said drum, said circulating means comprising peristaltic pump means having pump hoses which rotate with said drum and withdraw said treating fluid into the interior of said drum.

36. An apparatus as defined in claim 35, wherein said hoses have portions located at the outer surface of said circumferential wall and each extending over only a portion of the circumference of said drum, and wherein said hoses on said drum are distributed circumferentially thereof.

37. An apparatus as defined in claim 35, wherein said hoses are mounted on said outer surface of said circumferential wall and have suction openings spaced from the latter for entry of said treating fluid; and wherein said pump means further comprises squeezing elements spaced from said outer surface and suction openings for squeezing said hoses and effecting pumping of said treating fluid therethrough.

38. An apparatus as defined in claim 37, wherein said squeezing elements are mounted in the interior of said drum for squeezing said portions of said hoses against the inner surface thereof when said drum and said hoses rotate.

39. An apparatus as defined in claim 38, wherein said squeezing elements are squeezing rollers.

40. An apparatus as defined in claim 37; and further comprising mounting means mounting said squeezing elements for rotation relative to said drum at a circumferential speed different from that of the rotating drum.

41. An apparatus as defined in claim 37, wherein said drum has endwalls located at opposite axial ends, at least one endwall of said drum being formed with at least one opening which commmunicates with said annular clearance.

* * * * *